US006460321B1

(12) United States Patent
Koshimae et al.

(10) Patent No.: US 6,460,321 B1
(45) Date of Patent: Oct. 8, 2002

(54) RACQUET STRING

(75) Inventors: Tatsumi Koshimae, Kato-gun; Katsuo Kanno, Otsu, both of (JP)

(73) Assignee: Gosen Co., Ltd., Osaka (JP)

( * ) Notice: Subject to any disclaimer, the term of this patent is extended or adjusted under 35 U.S.C. 154(b) by 0 days.

(21) Appl. No.: 08/990,007

(22) Filed: Dec. 12, 1997

(30) Foreign Application Priority Data

Dec. 12, 1996 (JP) ..... 8-332512

(51) Int. Cl.[7] ..... D02G 3/02

(52) U.S. Cl. ..... 57/210; 57/224; 57/230; 57/232; 57/234; 57/241; 57/242; 57/250; 57/251; 57/258

(58) Field of Search ..... 57/210, 224, 230, 57/232, 234, 241, 242, 250, 251, 258

(56) References Cited

U.S. PATENT DOCUMENTS

| | | | | |
|---|---|---|---|---|
| 2,687,673 A | * | 8/1954 | Boone | 57/210 |
| 4,391,088 A | * | 7/1983 | Salsky et al. | 57/232 |
| 4,449,353 A | * | 5/1984 | Tayebi | 57/242 |
| 4,660,364 A | * | 4/1987 | Chiang | 57/234 |
| 5,327,714 A | * | 7/1994 | Stevens et al. | 57/230 |

FOREIGN PATENT DOCUMENTS

| | | |
|---|---|---|
| JP | 5-161726 | 6/1993 |
| JP | 5-60954 | 9/1993 |
| JP | 7-2264 | 4/1995 |
| JP | 7-275404 | 10/1995 |

* cited by examiner

*Primary Examiner*—John J. Calvert
*Assistant Examiner*—Shaun R Hurley
(74) *Attorney, Agent, or Firm*—Skadden, Arps, Slate, Meagher & Flom LLP

(57) ABSTRACT

A racquet string comprises of a core surrounded by at least one sheath, having a plurality of sheath fibers wound around said core, and a coating resin uniting the core and sheath fibers into a unitary body. The sheath fibers are helically wound about the core at a high wind angle, i.e., at a wind angle between 25 and 40 degrees relative to the core axis. Preferably, the sheath comprises a plurality of main sheath fibers and a plurality of non-main sheath fibers, and the core, the main sheath fibers, and the coating resin are transparent. Preferably, the non-main sheath fibers have a relatively low transparency. In this manner, the non-main fibers produce a multi-helix appearance when the string is observed from the side.

31 Claims, 10 Drawing Sheets

RACQUET STRING

FIELD OF INVENTION

This invention relates to a string for tennis racquets, badminton racquets, squash racquets, and the like. More specifically, this invention relates to a racquet string having a core-sheath structure with excellent hitting properties and endurance.

BACKGROUND OF THE INVENTION

There are three major properties required for racquet strings, namely, hitting properties, endurance and ease of stringing. The hitting properties are those such as rebounding properties, control properties, and spin properties. The hitting properties are also judged by hitting feel and sound, and the like. The endurance of strings is determined by how loose the strings become due to stress relaxation and how long the strings endure abrasion after hits without breaking. Even if a string has two other properties besides the ease of stringing, it remains insufficient and impractical. However, the ratio of importance among these properties (hitting properties: endurance: and ease of stringing is sometimes set at 3:2:1.

Hitting properties are commonly emphasized on the majority of racquet strings, and strings with excellent hitting properties are frequently advertised in the market. As another common trend, strings with small diameters are becoming more popular in the world market than ever before. This tendency is the result of the emphasis on the hitting properties of strings. Several years ago, in the case of tennis racquet strings, 15 gauge strings having 1.41–1.49 mm diameter and 15 L gauge strings of 1.33–1.41 mm diameter were the most marketed string. However, strings currently found in the market are mostly 16 gauge strings of 1.26–1.34 mm diameter.

Furthermore, 16 L gauge strings of 1.22–1.30 mm diameter and 17 gauge strings of 1.16–1.24 mm diameter are also spreading in the market. There have even been user requests for 18 gauge strings of 1.06–1.16 mm diameter. This is because balls rebound better and hitting properties improve as the diameter of the string decreases. The hitting sound and feel of string also improves with smaller diameters, providing a clean and solid hit to players.

A conventional racquet string having a core-sheath structure, for example as disclosed in Published Unexamined Japanese Patent Application (Kokai) No. Sho 60-168857 and Published Examined Japanese Patent Application (Kokoku) No. Hei 1-42069). has a core made of filament fibers and a coating component (sheath) of filament fibers wound around the core or woven outside the core. The use of vinylidene fluoride resin fibers, having a modified cross-section, in racquet strings has also been proposed, in Published Unexamined Japanese Patent Application (Kokai) No. Sho 56-166863 and No. Sho 56-70772.

Strings with excellent hitting properties such as natural gut strings and synthetic strings including polyether ether ketone strings and nylon multifilament strings generally have insufficient endurance. A string of nylon filament fibers of a small diameter loses its endurance, particularly endurance against abrasion, as the diameter becomes smaller.

The endurance of two strings of nylon filament fibers having the same structures but different diameters was tested. The number of hits was counted until the strings of 1.28 mm and of 1.35 mm diameter were broken, and were compared. According to the result, there was about a 40% decline in the number of hits due to the decrease in diameter. In other words, racquet strings found commonly in the global market have good hitting properties but poor endurance. However, demand for durable strings remain strong.

As a durable string, strings made of para-type aramid fibers are commonly sold. Some users are satisfied with these strings, and they are ranked as the most durable strings in the world every year. However, the strings are only several percent ductile and have poorer hitting properties than strings made of gut, etc. Thus, like strings with large diameters, they cannot satisfy the average player. The strings are also expensive.

The ease of stringing is improved by the coating of a smoothing agent such as silicone and wax. However, such treatment is not sufficiently carried out in retail stores.

As explained above, conventional strings do not have all the properties of an ideal racquet string—hitting properties, endurance and ease of stringing—at the same time. In other words, conventional strings with excellent hitting properties usually have poor endurance, and conventional strings with excellent endurance have poor hitting properties and little ease of stringing.

SUMMARY OF THE INVENTION

This invention aims to provide a racquet string which balances and improves three properties—hitting properties, endurance and ease of stringing—thus solving the above-noted conventional problems.

More particularly, a racquet string according to the invention comprises of a core surrounded by at least one sheath, having a plurality of sheath fibers wound around said core, and a coating resin uniting the core and sheath fibers into a unitary body. The sheath fibers are helically wound about the core at a high wind angle, i.e., at a wind angle between 25 and 40 degrees relative to the core axis.

Preferably, the sheath comprises a plurality of main sheath fibers and a plurality of non-main sheath fibers. The core, the main sheath fibers, and the coating resin are transparent, and the non-main sheath fibers have a relatively low transparency, such that the non-main fibers produce a multi-helix appearance when the string is observed from the side.

The non-main sheath fibers are preferably made of heat-resistant fibers having a melting point or decomposition temperature of 270° C. or higher, and have relatively low transparency.

It is preferable that the core and the main sheath fibers are made of polyamide based synthetic fibers.

It is also preferable that the non-main sheath fibers (heat-resistant fibers) have 10–30% elongation at break.

It is preferable that the non-main sheath fibers (heat-resistant fibers) are at least one type of fiber selected from the group consisting of aromatic polyamide fibers and polyphenylene sulfide fibers. The heat-resistant fibers may also be methaphenylene isophthalic amide fibers.

It is preferable that the string contains the main sheath fibers at 65–90 wt. % and the non-main sheath fibers (heat-resistant fibers) at 10–35 wt. %.

Preferably, the sheath includes 2–6 non-main sheath fibers (heat-resistant fibers).

It is further preferable that the non-main sheath fibers (heat-resistant fibers) are at least one type of fiber selected from the group consisting of multifilament fibers and spun yarns.

Preferably, the non-main sheath fibers (heat-resistant fibers) have 0.4–4.0 twist coefficients which are calculated from the following equation:

$$t=K\sqrt{S}$$

where t represents the number of twists (number of turns per 25 mm length of string); K represents the twist coefficient; and S represents yarn counts.

In one embodiment, the string has a single sheath. Alternatively, the string may include two or more sheaths, each containing a plurality of sheath fibers helically wound around the core.

In the preferred embodiment, the above-mentioned racquet string has a core-sheath structure including a multifilament or monofilament core and a plurality of sheath fibers wound around the core, and the core and the sheath fibers are united into one body with a coating resin. The core, the main sheath fibers, and the coating resin are at least essentially transparent. The non-main sheath fibers are heat-resistant fibers having a melting point or decomposition temperature of 270° C. or higher, and have relatively low transparency. In this manner, the string has a multi-helical appearance when it is observed lengthwise. And, the string has the three excellent properties—hitting properties, endurance and ease of stringing—in balance.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 1:
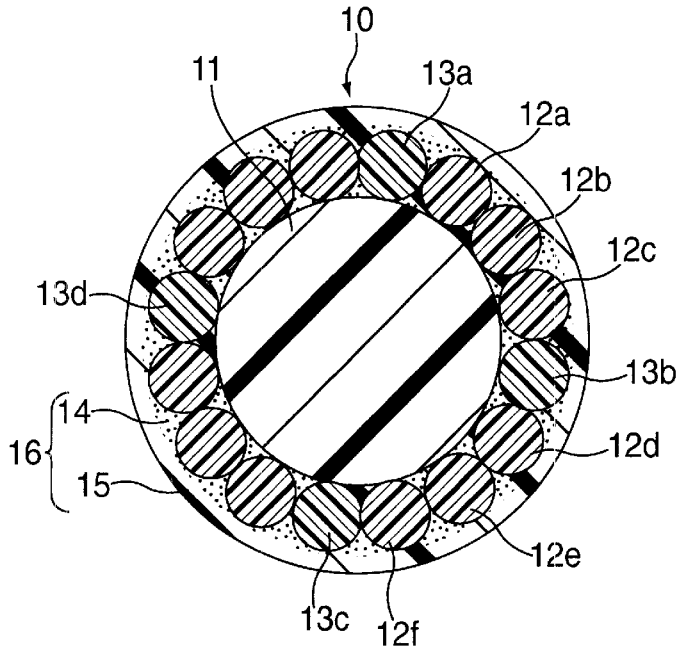
FIG. 1 is a cross-sectional view of a string of the first embodiment of the invention.

Based on the preferable characteristics of the invention, the racquet string has a core-sheath structure, including a core made of monofilament fibers and a sheath consisting of monofilament fibers wound or woven around the core at a wind angle of around 25–40° relative to the core. The core and the sheath contain nylon monofilament fibers as main components, and at least some fibers constituting the sheath are heat-resistant fibers. The string has a multi-helical appearance, because only the heat-resistant fibers are non-transparent, when viewed from the side of the string.

At least some fibers constituting the sheath have a melting point of at least 270° C., and are made of heat-resistant multifilament fibers or spun yarns having elongation at break of 10–30%. The heat-resistant multifilament fibers or spun yarns contain monofilament of polyamide resin, and are contained in the entire sheath section at 10–35 wt. %. Furthermore, the heat resistant sheath fibers have 0.4–4.0 twist coefficients.

It is most preferable that the non-main sheath fibers have a melting point or decomposition temperature which is at least 270° C., and more preferably at least 300° C. Also, preferably the non-main sheath fibers have an elongation at break of at least 10%, more preferably at least 15%.

Either multifilament fibers or spun yarns are used for the heat-resistant fibers of the invention. It is preferable to use aromatic polyamide fibers or polyphenylene sulfide fibers for the heat-resistant fibers. However, polymethaphenylene isophthalic amide fibers are particularly preferable since such polymer is similar to the polyamide used for the core, the sheath fibers and the binding and coating resin, so that the material is preferable in binding the entire string into one body. The polymethaphenylene isophthalic amide fibers include meta-based aramid fibers such as Nomex™ (trademark) manufactured by Dupont (multifilament, 371° C. melting point (decomposition temperature), and 22% elongation at break) and Conex™ manufactured by Teijin Limited (spun yarns, 400–430° C. melting point (thermal decomposition temperature), and 10–23% elongation at break).

Polyphenylene sulfide fibers having a melting point of 285° C. and elongation at break of 25% can also be used in the invention.

Preferably, ordinary nylon 6 and 66 or monofilament composed of these copolymer nylons are used for the main sheath fibers.

It is preferable that the core, the main sheath fibers, and the coating resin are at least essentially transparent. As used herein, "essentially transparent" means that the spiral condition of the twisted heat resistant fibers can be observed from both the front and back of a strung racquet. In other words, the string is transparent enough to show its multi-helix structure. In order to keep the transparency of polymer at a preferable level, filler particles such as titanium oxide are not added to the polymer. As a result, a string with high strength is provided in the invention.

It is preferable that the ratio between the heat-resistant fibers and the sheath fibers is 10–35 wt. %. If the ratio is less than 10 wt. %, the endurance of the string may be less than desirable. With the ratio higher than 35 wt. %, adherence between the core and the coating fibers may be incomplete, and they can peel off from each other after repeated use. As a result, the string loses its unitary body structure and endurance.

In consideration of adherence, each fiber of the heat resistant multifilament or spun yarns should be dispersed among monofilament nylon fibers rather than bundled up with each other.

The heat-resistant fibers preferably have the twist coefficient of 0.4–4.0, more preferably 0.4–3.4, and most preferably 0.8–2.8. When less than 0.4, the string has insufficient endurance. With the coefficient higher than 4.0, the strength of the string declines, lowering endurance as well as hitting properties. Sheath fibers may be twisted around the core in a counterclockwise direction (S twist) or in a clockwise direction (Z twist). In embodiments containing more than one sheath, the outer sheath may be wound in a direction opposite to the direction of the inner sheath.

The wind angles of 14 types of strings found in the market were measured. The smallest angle was 13°, the largest was 21°, and the average was 16.5°. With these angles, there are limitations on the improvement in hitting performance and endurance even if multifilament fibers are used for those strings.

The applicant of this invention has already disclosed a string with a single wrapping fiber, oriented at a wind angle of greater than 75°, and preferably 85°, relative to the center axis of the core (Published Unexamined Japanese Patent Application (Kokai) No. Hei 2-126872). Although this string has excellent endurance, the strength of the string could not be increased easily, thus increasing the cost of manufacturing. This is because the sheath fibers have a low strength contribution to the entire string at angles greater than 75°.

In the present invention, the following properties and characteristics are obtained.

1) Endurance: A conventional 16 gauge string of about 1.3 mm diameter is broken after about 1,000 hits in an endurance test while the string of this invention having the same diameter as the conventional string endured up to 2,000–2,500 hits.

The endurance of conventional strings becomes minimal as the diameter of the strings decreases. For instance, a string of 1.2 mm diameter could endure about 500 hits, and endurance declines to about 300 hits with the string of 1.1 mm diameter. On the other hand, the string of the invention with 1.2 mm diameter endured around 1,500 hits, and about 1,000 hits were endured by the string with 1.1 mm diameter. 18 gauge string of the invention showed endurance as high as the endurance of 16 gauge conventional strings. In other words, the string of the invention can maintain high endurance with a small diameter better than conventional strings, thus significantly improving hitting properties, and sound as well as feel.

2) Hitting feel: The 25–40 sheath fiber wind angle with the core increases string elasticity compared to conventional strings whose wind angle is typically 13–21°. The diameter of the string of the invention can be minimized without reducing endurance resulting in further increases in string elasticity, collectively providing excellent hitting feel to players.

3) Unique pattern: The string of the invention has a unique pattern, which looks like DNA structure (double helix structure); this cannot be found in conventional strings.

The invention is explained in further detail in the following embodiments by referring to figures. This invention, however, is not limited to the following embodiments.

First Embodiment

A core was made of transparent monofilament copolymer consisting of nylon 6 and 66 (copolymer ratio of nylon 6/nylon66=95 weight parts/5 weight parts), and had a diameter of 0.92 mm. Coating fibers (sheath fibers) include twelve transparent monofilament fibers of nylon 6 having 0.16 mm diameter, and four twisted multifilament fibers (1.46 twist coefficient, 371° C. melting point (thermal decomposition point); and 22% elongation at break) consisting of one hundred white polymethaphenylene isophthalic amide fibers which have a total size of 200 denier (single fiber size: 2 denier). The sheath fibers (13*a*, 13*b*, 13*c* and 13*d*) were arranged at a fixed distance as shown in FIG. 1, were twisted in a spiral condition with wind angle Θ (see FIG. 5) of 35° relative to the axis 17 of the core, and were bound to the core and the rest of the sheath fibers by a nylon-based adhesive.

The sheath fibers were then coated with heat-melting nylon 6. The ratio between the polymethaphenylene isophthalic amide fibers and all sheath fibers was 25 wt. %.

The cross-section of the string is shown in FIG. 1. In the figure, 10 indicates the string; 11 shows a core containing an essentially transparent monofilament of copolymer nylon of nylon 6 and nylon 66; and 12*a*, 12*b*, 12*c*, 12*d*, 12*e* and 12*f* show essentially transparent monofilament sheath fibers made of nylon 6. Twelve monofilament sheath fibers of nylon 6 were used in the string of this embodiment. 13*a*, 13*b*, 13*c* and 13*d* show non-transparent, twisted multifilament sheath fibers made of heat-resistant polymethaphenylene isophthalic amide fibers. The sheath fibers were arranged on the surface of the core in one layer.

In FIG. 1, 14 indicates a nylon-based adhesive layer for binding the core and the sheath fibers into one body; 15 shows a layer of heat-melting nylon 6 coating the sheath fibers; and 16 indicates a transparent adhesive resin layer consisting of nylon-based adhesive layer 16 and layer 15 of heat melting nylon 6.

Because the core 11, the nylon 6 sheath fibers 12*a–f*, the adhesive 14, and the coatings 15, 16 are all transparent, and only the heat-resistant fibers 13*a–d* are non-transparent, when the string of FIG. 1 is viewed from the side, the heat-resistant fibers have the appearance of a multi-helix.

The string had 75.9 kg tensile strength, 45.1 kg knot strength, 32.3% elongation at break, and 1.301 mm diameter.

A racquet made of carbon fiber reinforced resin, with a strung surface area of 110 square inches, was strung with the strings of this embodiment with a tension of sixty pounds. A tennis ball was thereafter bounced off the strings at the speed of 127 Km/hour, with a hitting interval of 15 times/minutes, and a hitting distance of 50 cm. The ball was continuously bounced off the strings until the strings were broken. The tests were carried out to the strings two times. According to the results, the strings were broken after 2,450 and 2,300 hits respectively.

As a comparison, a string was prepared which had the same structure as the string of the invention, except that nylon fibers instead of the multifilament ones were applied so as to provide sheath fibers made entirely of nylon fibers. According to the endurance test, this string could endure 1,013 hits.

The string of this embodiment also provided comfortable hitting feel to players.

Second Embodiment

Figure 2:
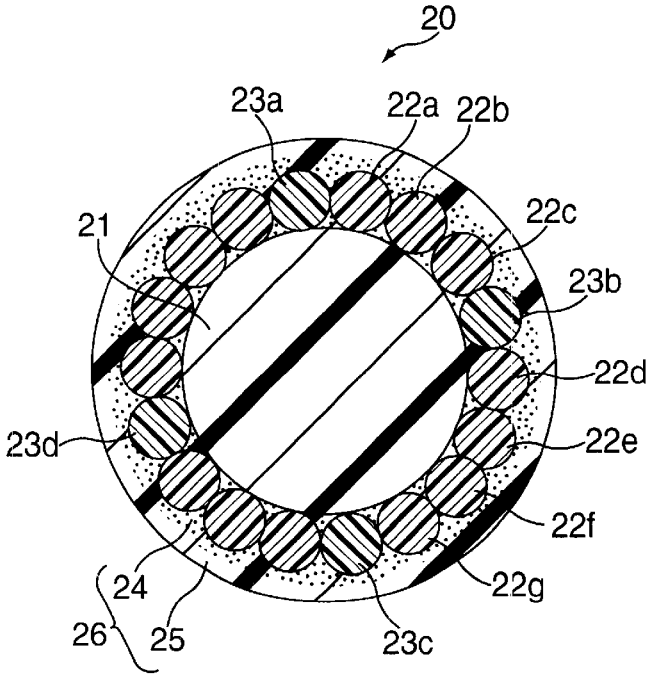
FIG. 2 is a cross-sectional view of a string of the second embodiment of the invention.

As in the first embodiment, transparent monofilament of copolymer nylon consisting of nylon 6 and nylon 66 was used for a core having 0.900 mm diameter. Coating fibers (sheath fibers) include fourteen transparent monofilament 22*a–g* of nylon 6 of 0.140 mm diameter, and four twisted white spun yarns (3.35 twist coefficient; 371° C. melting point (thermal decomposition point); and 14% elongation at break) made of polymethaphenylene isophthalic amide fibers of 20 yarn counts (20s). As shown in FIG. 2, the sheath fibers 23*a–d* (spun yarns) were placed at a fixed distance, twisted around the core in a spiral condition with 37° wind angle relative to the core axis, and fixed to the core and the rest of the sheath fibers by a nylon-based adhesive. Then, a heat-melting nylon 6 was applied so as to coat the surface of the sheath fibers. The ratio between the polymethaphenylene isophthalic amide fibers and all sheath fibers was 32.4 wt. %.

The cross-section of the string is shown in FIG. 2. In the figure, 20 indicates the string; 21 shows a core made of a clear monofilament of copolymer nylon consisting of nylon 6 and nylon 66; and 22*a*, 22*b*, 22*c*, 22*d*, 22*e*, 22*f* and 22*g* show clear monofilament sheath fibers made of nylon 6. There were fourteen monofilament fibers of nylon 6 in the string. 23*a*, 23*b*, 23*c*, and 23*d* show sheath fibers which are non-transparent, twisted spun yarns made of heat-resistant polymethaphenylene isophthalic amide fibers. The sheath fibers were arranged around the core in one layer. In the figure, 24 indicates a nylon-based adhesive layer combining the sheath fibers and the core into one body; 25 shows a layer of heat melting nylon 6 coating the entire surface of the sheath fibers; and 26 indicates a transparent adhesive resin layer consisting of nylon-based adhesive layer 24 and layer 25 of heat-melting nylon 6. The string had a multi-helical structure when it was observed from the side.

The string had 65.9 kg tensile strength, 31.5 kg knot strength, 26.5% elongation at break, and 1.210 mm diameter. The above-mentioned endurance test was also carried out on this string two times. According to the test results, the strings endured up to 1,241 and 1,141 hits respectively. On the contrary, a string which had the same structure as the string of this embodiment but consisted only of nylon sheath fibers, could endure only up to 495 hits.

The string of this embodiment had excellent ease of stringing. A ball was also hit cleanly with the strings, indicating preferable hitting properties.

Figure 5:
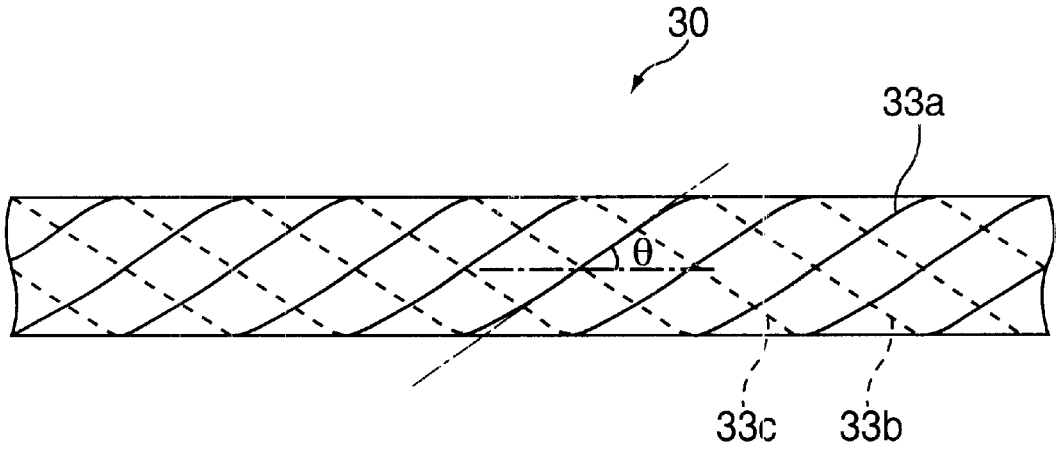
FIG. 5 is a side view of the string of the third embodiment of the invention.

Third Embodiment As in the first embodiment, a core of 0.9 mm diameter was prepared by using monofilament of copolymer nylon consisting of nylon 6 and nylon 66. Coating fibers (sheath fibers) included fifteen monofilament fibers of nylon 6 having 0.14 mm diameter, and three twisted multifilament fibers (twist coefficient of 1.46; 371° C. melting point (thermal decomposition point); and 22% elongation at break) consisting of one hundred white polymethaphenylene isophthalic amide fibers having 200 denier in total size (single fiber size: 2 denier). As shown in FIG. 5, the sheath fibers were wound around the core in a spiral condition with 32° wind angle Θ relative to the core axis 17. The fibers were fixed to each other with a nylon-based adhesive, and then coated with a heat-melting nylon 6. The ratio between the twisted polymethaphenylene isophthalic amide fibers and all sheath fibers was 20.2 wt. %.

Figure 3:
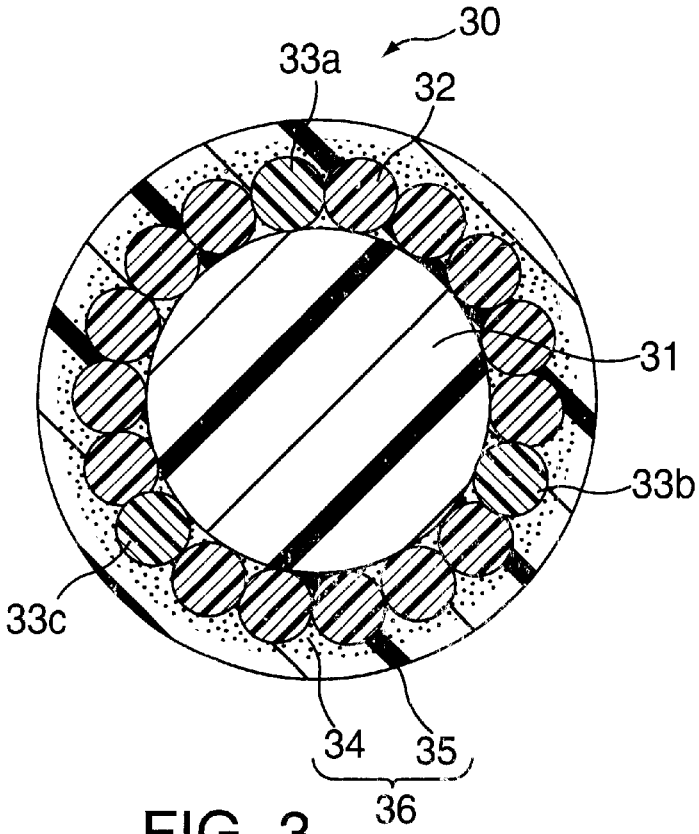
FIG. 3 is a cross-sectional view of a string of the third embodiment of the invention.

The cross-section of the string is shown in FIG. 3. In the figure, 30 shows the string; 31 indicates a core made of monofilament of copolymer nylon consisting of nylon 6 and nylon 66; and 32 shows monofilament sheath fibers made of nylon 6. There were fifteen monofilament sheath fibers of nylon 6 in the string. 33*a*, 33*b*, and 33*c* show sheath fibers which are twisted multifilament consisting of heat-resistant polymethaphenylene isophthalic amide fibers. The sheath fibers were arranged around the core in one layer. In the figure, 34 indicates a nylon-based adhesive layer combining the sheath fibers and the core into one body; 35 shows a layer of heat-melting nylon 6 coating the entire body of the sheath fibers; and 36 shows a transparent adhesive resin layer consisting of nylon-based adhesive layer 34 and layer 35 of heat-melting nylon 6.

Figure 4:
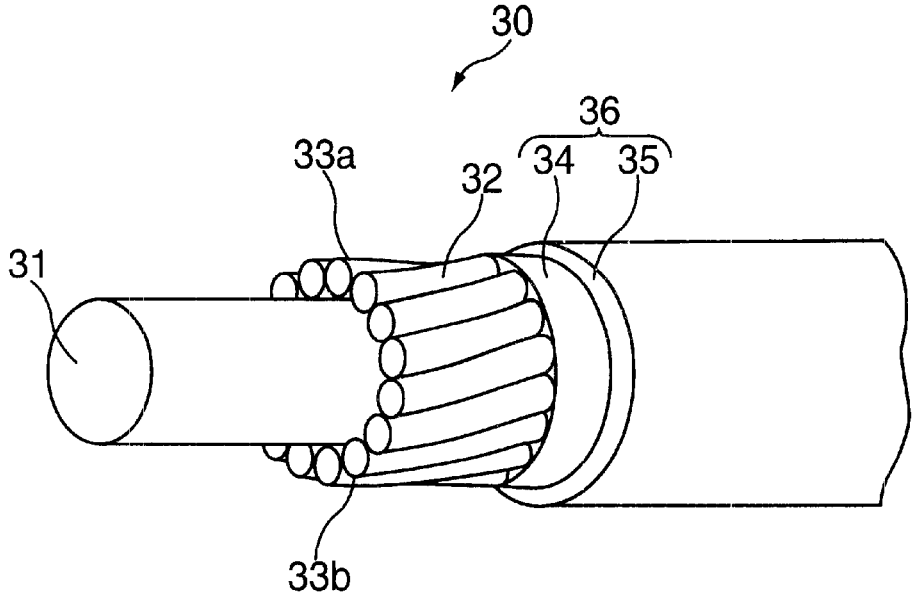
FIG. 4 is a perspective view showing the cross-section of the string of the third embodiment of the invention.

FIG. 4 is a perspective view of the string shown in FIG. 3. FIG. 5, on the other hand, is a side view of the string shown in FIG. 3. Heat-resistant polymethaphenylene isophthalic amide fibers 33*a*, 33*b*, and 33*c* had a triple helix structure. In other words, it was possible to observe, from the side of the string, the polymethaphenylene isophthalic amide fibers 33*a*, 33*b*, and 33*c* which were wound like lines and dotted lines with 32° contact wind angle Θ shown in FIG. 5. This is because the core, the sheath fibers excluding polymethaphenylene isophthalic amide fibers 33*a*, 33*b*, and 33*c*, and the adhesive resin (36 in FIG. 3 and FIG. 4) were all transparent. However, the adhesive resin (36 in FIG. 3 and FIG. 4) can also be colored or dyed.

The string had 67.4 kg tensile strength, 33.5 kg knot strength, 26.0% elongation at break, and 1.205 mm diameter. The endurance test mentioned above was carried out on the strings two times. According to the test results, the strings endured up to 1,174 and 1,107 hits respectively.

On the other hand, a string which had the same structure as the string of this embodiment, but consisted only of nylon sheath fibers, endured only 495 hits.

The string of the embodiment had excellent ease of stringing. Also, a ball could be hit cleanly with the strings, indicating preferable hitting properties.

As explained above, the string of the invention has superb endurance even with a small diameter of 1.1–1.2 mm, and can be commonly used. In addition, the string had superior hitting properties and a unique appearance.

Fourth Embodiment

Figure 6:
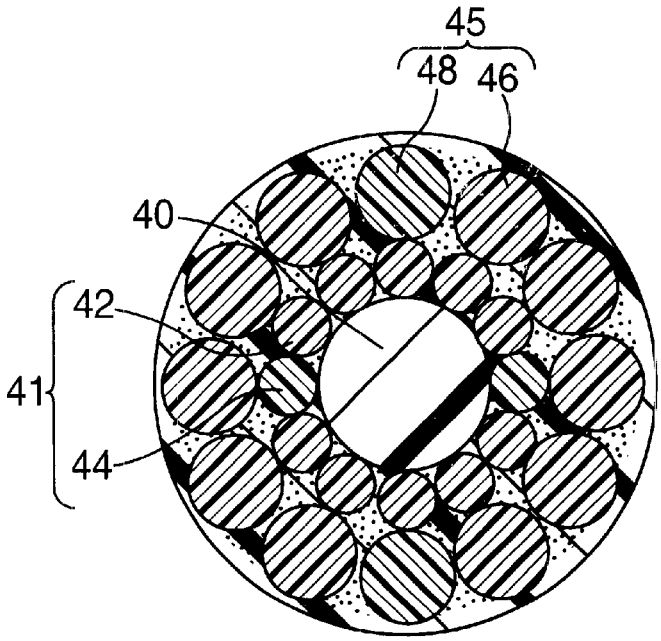
FIGS. 6 is a cross-sectional view of a string obtained in the fourth embodiment of the invention.
Figure 18:
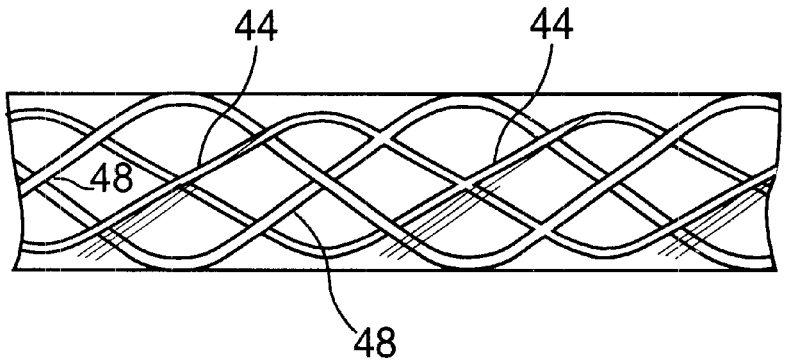
FIG. 18 is a side view of the string in FIG. 6.

FIGS. 6 and 18 show a string having a monofilament core 40 helically wrapped by an inner sheath 41, which in turn is helically wrapped by an outer sheath 45. The inner sheath 41 comprises ten (10) transparent monofilament fibers 42 of nylon 6, and two heat-resistant, multifilament fibers or yarns 44. The outer sheath 45 comprises ten transparent monofilament fibers 46 and two heat-resistant multifilament fibers or yarns.

Preferably, the heat-resistant fibers 44 and 48 of each sheath are diagonally opposed to one another. The heat-resistant fibers 44 of the inner sheath may also be spaced 90° from the heat-resistant fibers 48 of the outer sheath. The fibers of the inner and outer sheaths are wound in opposite directions and the inner sheath wind angle is lower than the wind angle of the outer sheath, in order to maintain the relative spacing between the fibers 44 and 48.

FIG. 18 shows an example of the heat-resistant fibers 44 of the inner sheath and the fibers 48 of the outer sheath, where the contact angles are chosen so as to maintain a 90° spacing between the fibers of the two sheaths. As shown by FIG. 18, the outer sheath fibers 48 and inner sheath fibers 44 each form a double helix, the latter double helix having a smaller diameter and being nested inside the former.

As can be seen from FIG. 18, a string according to this embodiment gives the appearance of a pair of double helixes, suspended in a clear plastic. By changing the relative wind contact angles or winding directions of the fibers 44 and 48, the appearance of the string can be modified. However, preferably both sheaths should maintain a high wind angle between 25–40°.

Figure 7:
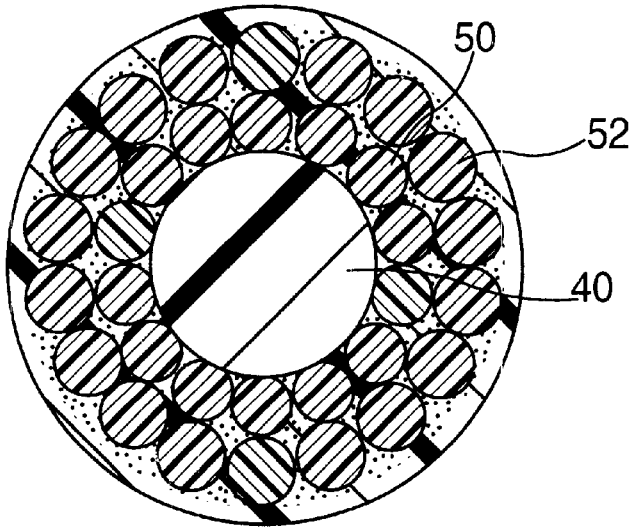
FIG. 7 is a cross-sectional view of a string illustrated in the fourth embodiment of the invention.
Figure 8:
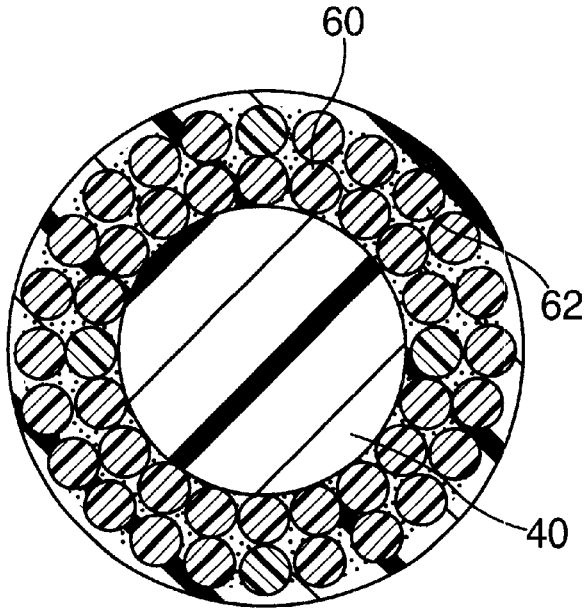
FIG. 8 is a cross-sectional view of a string illustrated in the fourth embodiment of the invention.
Figure 9:
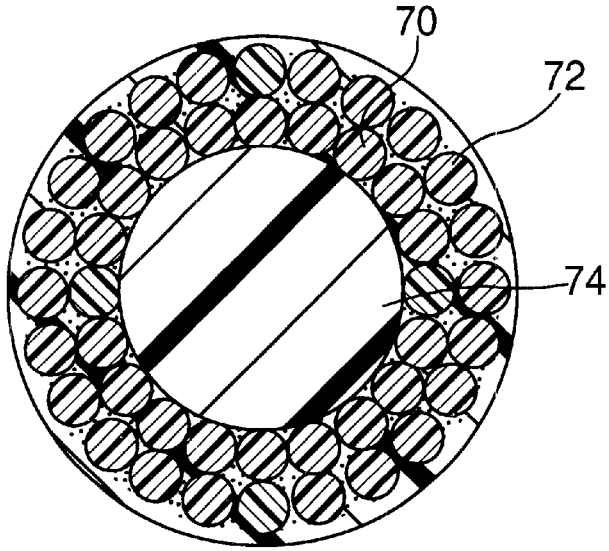
FIG. 9 is a cross-sectional view of a string illustrated in the fourth embodiment of the invention.
Figure 10:
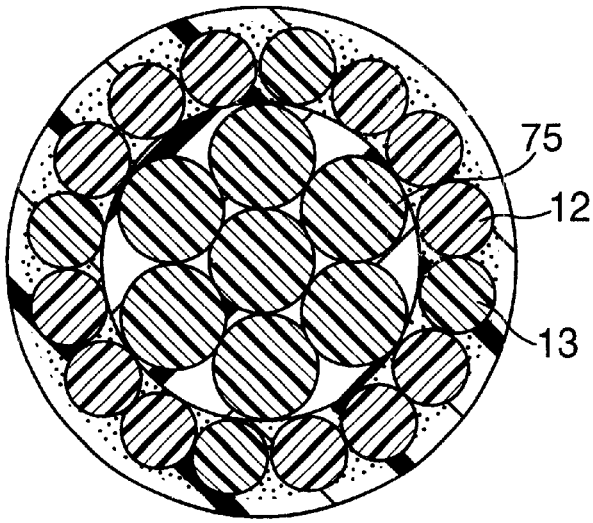
FIG. 10 is a cross-sectional view of a string illustrated in the fourth embodiment of the invention.
Figure 11:
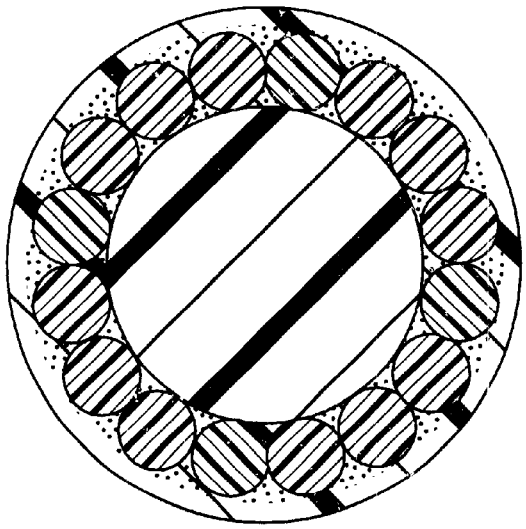
FIG. 11 is a cross-sectional view of a string illustrated in the fourth embodiment of the invention.
Figure 12:
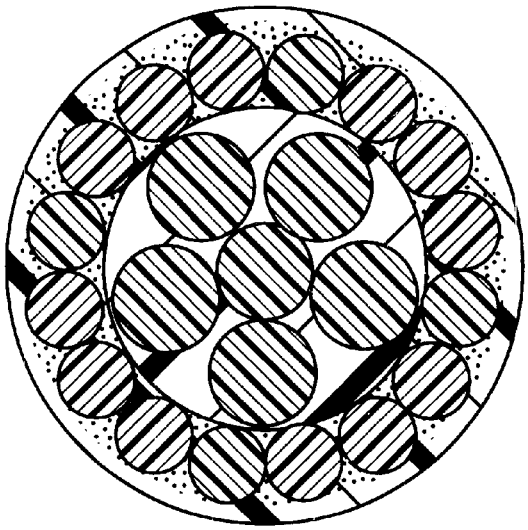
FIG. 12 is a cross-sectional view of a string illustrated in the fourth embodiment of the invention.

In the embodiment of FIG. 6, the fibers 46, 48 of the outer sheath have a larger diameter than the fibers 42, 44 of the inner sheath. However, as shown by FIGS. 7–9, the relative diameters of the fibers of the inner sheath 50, 60, and 70, respectively, may be varied relative to the diameters of the outer sheath 52, 62, and 72, and the number of fibers comprising each sheath may be varied as well.

The fibers of the inner sheath 41, 50, 60, and 70 are helically wound in a direction opposite to the fibers of the inner sheath 45, 52, 62, and 72. Also, as shown in FIG. 9, if desired the core 74 may be a multifilament core, rather than a monofilament core as in the other exemplary embodiments.

Figure 13:
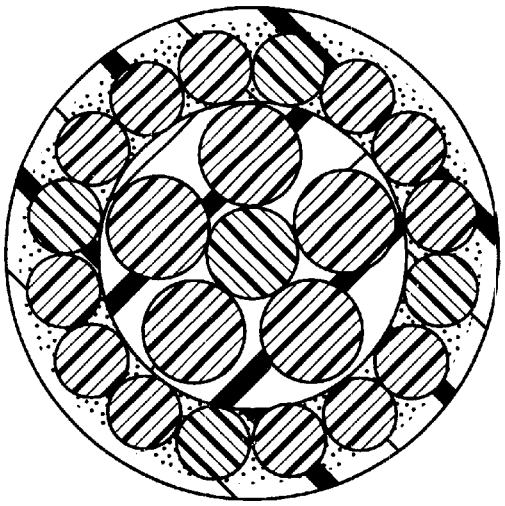
FIG. 13 is a cross-sectional view of a string illustrated in the fourth embodiment of the invention.
Figure 14:
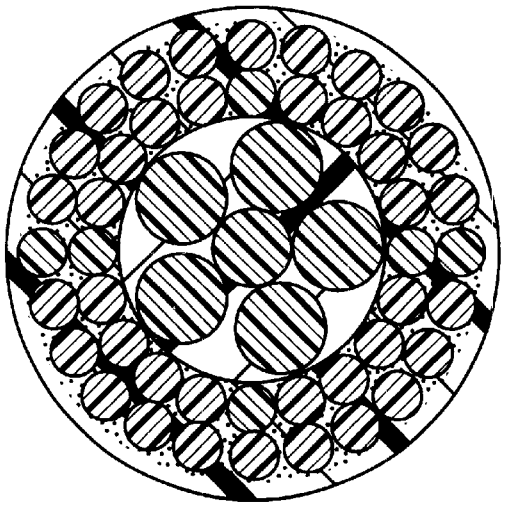
FIG. 14 is a cross-sectional view of a string illustrated in the fourth embodiment of the invention.
Figure 15:
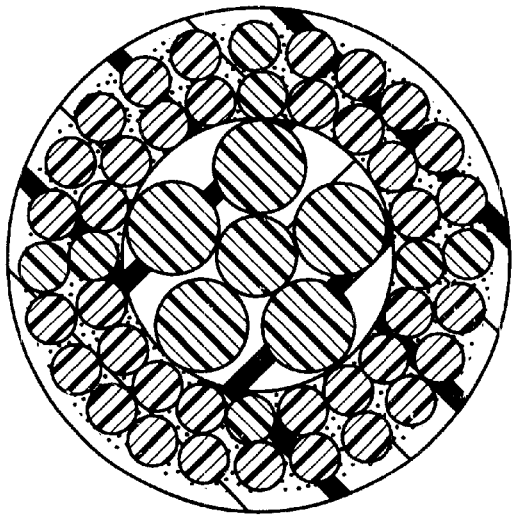
FIG. 15 is a cross-sectional view of a string illustrated in the fourth embodiment of the invention.
Figure 16:
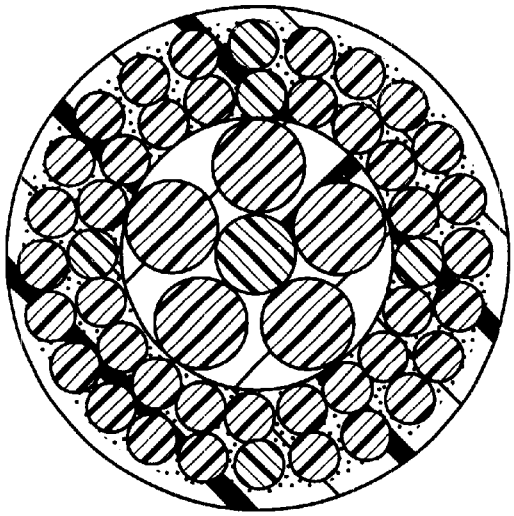
FIG. 16 is a cross-sectional view of a string illustrated in the fourth embodiment of the invention.

In addition to the various embodiments shown above, a variety of different styled cores may be employed for both single and double sheath string constructions. For instance, FIGS. 10–13 show additional single sheath string constructions in which the core may be composed of a plurality of monofilament fibers (FIG. 10), a single multifilament fiber (FIG. 11), a plurality of multifilament fibers (FIG. 12), or at least one monofilament fiber and at least one multifilament fiber (FIG. 13). In like manner, FIGS. 14–16 show additional double sheath string constructions in which the core may be composed of a plurality of monofilament fibers (FIG. 14), a plurality of multifilament fibers (FIG. 15), or at least one monofilament fiber and at least one multifilament fiber (FIG. 17).

Figure 17:
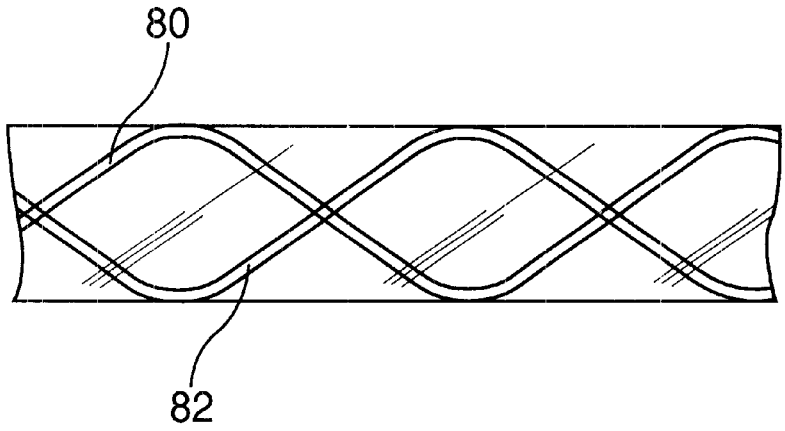
FIG. 17 is a cross-sectional view of a string illustrated in another embodiment of the invention.

FIG. 17 shows an embodiment of a string having a single sheath, containing two heat resistant fibers 80, 82. As in the prior embodiments, the core, the remaining fibers of the sheath, and the adhesive and coating are all transparent, resulting in a string having the appearance of a double helix suspended inside clear plastic.

Fifth Embodiment

A multifilament fiber having a total size of 6510 denier and a number of fibers of 1050 consisting of nylon 66 whose single fiber size was about 6.2 denier was impregnated with an alcohol soluble nylon solution and then a twisting process was conducted (1.30 twist coefficient) while squeezing the multifilament fiber by a nozzle. A drying process was provided before winding, such that the alcohol soluble nylon was hardened.

Figure 19:
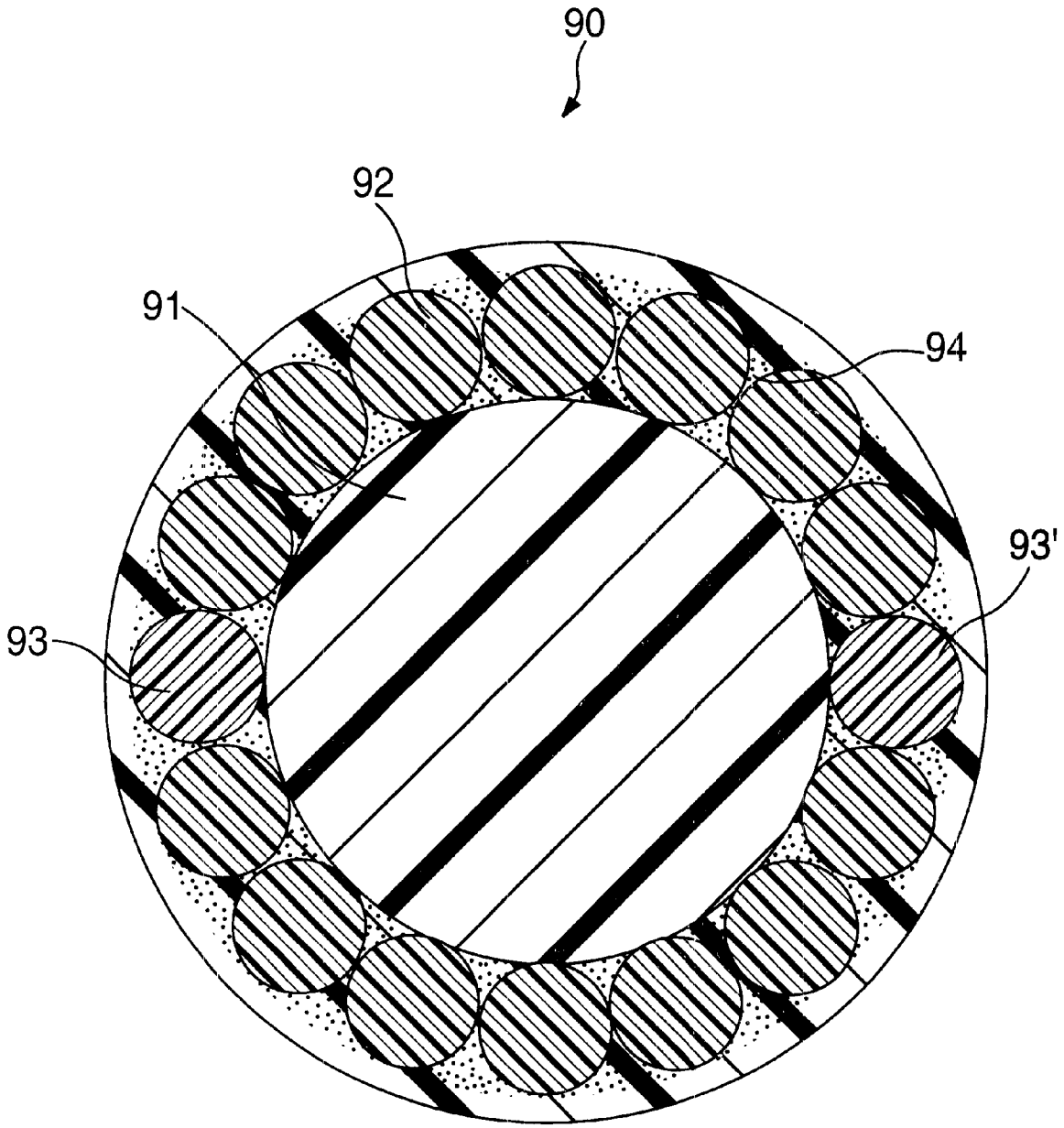
FIG. 19 is a cross-sectional view of a string obtained in the fifth embodiment of the invention.

The fiber obtained above was used as a core. Sheath fibers included fourteen monofilament fibers of nylon 6 having 0.160 mm diameter and two twisted multifilament fibers consisting of polymethaphenylene isophthalic amide fibers prepared separately, which were the same as the fibers used in the first example. The sheath fibers were arranged as shown in FIG. 19, were helically wound with a wind angle of 35° relative to the axis of the core and were fixed by a nylon-based adhesive at the same time. In FIG. 19, the numeral 91 indicates a multifilament fiber in a core portion, the numeral 92 indicates a monofilament fiber of nylon 6 in a sheath portion, and the numerals 93 and 93' indicate twisted multifilament fibers consisting of polymethaphenylene isophthalic amide fibers in a sheath portion.

The surface was then coated with transparent heat-melting nylon 6, indicated by numeral 94. The ratio of sheath fibers consisting of heat-resistant fibers to all sheath fibers was 12.5 wt. % . The string 90 obtained had 65.6 kg tensile strength, 36.8 kg knot strength, 20.3% elongation at break, and 1.337 mm diameter.

The same endurance testing as in the first example was carried out on the string. The string endured 1,274 hits. The same endurance test was also carried out on a conventional string (contact angle 16 degrees) whose sheath fibers consisted only of nylon 6. The conventional string endured only 508 hits.

When making trial hitting tests in actual play using strings made according to the invention, it was found that excellent rebounding properties and hitting feel, similar to that of natural gut strings, were obtained with strings made according to the invention.

Next, the relationship between wind angle and hitting properties were studied for various strings made according to the present invention. Table 1 below shows contact angles and physical properties relating to hitting properties. As shown in Table 1, tensile strength, knot strength, and elongation at break tend to decrease as the contact angle becomes larger. Table 1 also shows that elongation at various load levels increases, and dynamic modulus of elasticity decreases, both of which reflect improved hitting feeling. Endurance also improves drastically as a function of increasing wind angle, as shown in Table 1.

TABLE 1

| WIND Angle (°) | 19 | 26 | 28 | 34 |
|---|---|---|---|---|
| Diameter (mm) | 1.336 | 1.320 | 1.318 | 1.319 |
| Tensile Strength (kg) | 79.5 | 73.9 | 68.0 | 57.2 |
| Knot Strength (kg) | 36.0 | 38.0 | 35.7 | 34.6 |
| Elongation at Break (%) | 25.8 | 23.5 | 21.5 | 19.0 |
| Elongation (%) | | | | |
| at 23 kg | 9.6 | 9.7 | 10.0 | 10.5 |
| at 27 kg | 10.7 | 10.8 | 11.3 | 11.7 |
| at 34 kg | 12.5 | 12.7 | 13.0 | 13.5 |
| at 46 kg | 15.2 | 15.3 | 15.7 | 16.3 |
| Dynamic Modulus of Elasticity (N) | 11545 | 11429 | 11308 | 11106 |
| Endurance (# hits) | 504 | 582 | 584 | 803 |

In Table 1, elongation is a measurement obtained by loading the string in tension until failure. Strings with higher elongation at a given load level provide a softer hitting feeling and are more comfortable in play.

The dynamic modulus of elasticity is calculated by the following equation, with the resonant frequency obtained by installing an armature providing vertical vibration to a string and vibrating the string under 60 lb. Load:

$$\text{Dynamic modulus of elasticity } (N)=(Hz)^2 2\pi^2 LM$$

where, "Hz" is the resonant frequency, "L" is the length of the string, and "M" is the mass of the armature (kg).

As illustrated in Table, 1, dynamic modulus of elasticity, which corresponds to behavior at the time of actual play, also tends to decrease in the strings of the present invention, and the values approach those of natural gut strings (which is generally in the range of 9,000–10,000 N), which are known to have excellent hitting properties.

This invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

We claim:

1. A racquet string comprising a core having an axis, a sheath formed of a plurality of sheath fibers wound around said core, and a coating resin uniting said core and sheath fibers into one body; wherein said sheath fibers are helically wound about said core at a wind angle between 32 and 40 degrees relative to the core axis, wherein said sheath fibers include a plurality of main sheath fibers and non-main sheath fibers, and wherein said non-main sheath fibers are heat-resistant fibers having a melting point or decomposition temperature of at least 270° C. and 10–13% elongation at break.

2. A racquet string according to claim 1, wherein said core, said main sheath fibers, and said coating resin are transparent; and wherein said non-main sheath fibers of said sheath fibers have relatively low transparency, such that said string has a multi-helix appearance when observed from the side.

3. A racquet string according to claim 2, wherein said string has two non-main sheath fibers so as to create a double-helix appearance.

4. A racquet string according to claim 2, wherein the core and the main sheath fibers and are polyamide-based synthetic fibers.

5. A racquet string according to claim 2, wherein the non-main sheath fibers are at least one type of fiber selected from the group consisting of aromatic polyamide fibers and polyphenylene sulfide fibers.

6. A racquet string according to claim 1, wherein the heat-resistant fibers are methaphenylene isophthalic amide fibers.

7. A racquet string according to claim 2, wherein the sheath fibers comprise the main sheath fibers at 65–90 wt. % and the non-main sheath fibers at 10–35 wt. %.

8. A racquet string according to claim 2, wherein the sheath fibers comprise 2–6 heat-resistant fibers.

9. A racquet string according to claim 1, wherein the heat-resistant fibers are at least one type of fiber selected from the group consisting of multifilament fibers and spun yarns.

10. A racquet string according to claim 1, wherein the heat resistant fibers have 0.4–4.0 in twist coefficients which are calculated as:

$$t=K\sqrt{\sqrt{S}}$$

wherein t represents a number of twists (turns/25 mm); K represents a twist coefficient; and S represents yarn counts.

11. A racquet string according to claim 2, wherein the sheath fibers are wound around the core in one layer.

12. A racquet string according to claim 1, wherein the core comprises a monofilament fiber.

13. A racquet string according to claim 1, wherein the core comprises a plurality of monofilament fibers.

14. A racquet string according to claim 1, wherein the core comprises a multifilament yarn.

15. A racquet string according to claim 1, wherein the core comprises a plurality of multifilament yarns.

16. A racquet string according to claim 1, wherein the core comprises at least one monofilament fiber and at least one multifilament yarn.

17. A racquet string according to claim 1, wherein the sheath comprises a plurality of monofilament fibers.

18. A racquet string according to claim 1, wherein the sheath comprises a plurality of multifilament yarns.

19. A racquet string according to claim 1, wherein the sheath comprises a plurality of monofilament fibers and a plurality of multifilament yarns.

20. A racquet string having a core-sheath structure, comprising a core having a central axis, an inner sheath comprising a plurality of inner sheath fibers helically wrapped about said core, an outer sheath comprising a plurality of outer sheath fibers helically wrapped about said inner sheath fibers, and a coating resin uniting said core, inner sheath fibers, and outer sheath fibers, wherein the sheath fibers of at least one said sheath are wound at a contact angle between 32 and 40 degrees relative to the core axis, wherein the sheath fibers of said one sheath include a plurality of main sheath fibers and non-main sheath fibers, and wherein said non-main sheath fibers are heat-resistant fibers having a melting point or decomposition temperature of at least 270° C. and 10–13% elongation at break.

21. A racquet string according to claim 20 wherein, the heat-resistant fibers are methaphenylene isophthalic amide fibers.

22. A racquet string according to claim 20, wherein the heat-resistant fibers are at least one type of fiber selected from the group consisting of multifilament fibers and spun yarns.

23. A racquet string according to claim 20, wherein the heat resistant fibers have 0.4–4.0 in twist coefficients which are calculated as:

$$t=K\sqrt{\sqrt{S}}$$

wherein t represents a number of twists (turns/25 mm); K represents a twist coefficient; and S represents yarn counts.

24. A racquet string according to claim 20, wherein the core comprises a monofilament fiber.

25. A racquet string according to claim 20, wherein the core comprises a plurality of monofilament fibers.

26. A racquet string according to claim 20, wherein the core comprises a multifilament yarn.

27. A racquet string according to claim 20, wherein the core comprises a plurality of multifilament yarn.

28. A racquet string according to claim 20, wherein the core comprises at least one monofilament fiber and at least one multifilament yarn.

29. A racquet string according to claim 20, wherein at least one of said the sheath comprises a plurality of monofilament fibers.

30. A racquet string according to claim 20, wherein at least one of said sheathes comprises a plurality of multifilament yarns.

31. A racquet string according to claim 20, wherein the sheath comprises a plurality of monofilament fibers and a plurality of multifilament yarns.

* * * * *